US005603543A

United States Patent [19]

Ratte

[11] Patent Number: 5,603,543

[45] Date of Patent: Feb. 18, 1997

[54] HANDLING DEVICE

[76] Inventor: Jean-Claude Ratte, 3270 Duval, Quebec, Province of Quebec, Canada, G1L 4P3

[21] Appl. No.: 586,325

[22] Filed: Jan. 17, 1996

[51] Int. Cl.[6] ..... F24B 15/00

[52] U.S. Cl. ..... 294/11; 294/19.1

[58] Field of Search ..... 294/8.5, 11, 19.1, 294/19.2, 22, 23, 23.5, 28, 30, 31.1, 50.8, 104

[56] References Cited

U.S. PATENT DOCUMENTS

| | | | |
|---|---|---|---|
| 123,349 | 2/1872 | Lander et al. . | |
| 160,006 | 2/1875 | Conklin . | |
| 384,281 | 6/1888 | Randleman et al. . | |
| 578,832 | 3/1897 | Pope . | |
| 728,941 | 5/1903 | Lanham | 294/22 |
| 741,816 | 10/1903 | McKinniss | 294/11 |
| 818,869 | 4/1906 | Calvert | 294/22 |
| 1,284,323 | 11/1918 | Hansen | 294/11 |
| 1,882,934 | 10/1932 | Rogaczewicz | 294/11 |
| 2,135,232 | 11/1938 | Dawn | 294/11 X |
| 2,591,499 | 4/1952 | Bible | 294/11 X |
| 3,091,491 | 5/1963 | Adler | 294/22 |
| 3,118,697 | 1/1964 | Watters | 294/11 |
| 3,171,386 | 3/1965 | De Ronde | 294/19.1 X |
| 4,176,871 | 12/1979 | Stover | 294/10 |

FOREIGN PATENT DOCUMENTS

| | | | |
|---|---|---|---|
| 229651 | 3/1923 | Canada . | |
| 292873 | 9/1929 | Canada . | |
| 883687 | 10/1971 | Canada . | |
| 1221594 | 5/1987 | Canada . | |
| 23977 | 1/1919 | Denmark | 294/11 |

*Primary Examiner*—Johnny D. Cherry
*Attorney, Agent, or Firm*—Collard & Roe, P.C.

[57] ABSTRACT

A handling device which comprises a longitudinal axis and an elongated sleeve provided with opposite ends and coaxial with the longitudinal axis, the opposite ends respectively defining a first end and a second end. The device further comprises an elongated member which has opposite ends, which is coaxial with the longitudinal axis of the device and which is pivotally mounted inside the sleeve, the opposite ends respectively defining a first end and a second end. The device further comprises at least one pair of grasps, each grasp of a same pair of grasps being respectively firmly attached to the first end of the sleeve member and to the first end of the elongated member. The device further comprises a first handle firmly attached to the elongated member and a second handle firmly attached to the sleeve. The elongated sleeve member and the elongated member are adapted to pivot one with respect to the other and move the pair of grasps between two extreme positions, that is a closed position where the grasps are one toward the other and an open position where the grasps are distant from each other.

1 Claim, 3 Drawing Sheets

HANDLING DEVICE

FIELD OF THE INVENTION

The invention relates to an improved handling device to grasp and handle a large variety of objects and more particularly fire logs.

DESCRIPTION OF THE PRIOR ART

Several devices have been used in the past for handling small or large objects. More particularly, prior art reveals various tongs that were used for grasping and handling various objects such as logs in a domestic fireplace. However, disadvantages appear with prior art tong devices. For example, prior art tongs are disclosed in U.S. Pat. No. 123,349 (LANDER et al.), U.S. Pat. No. 160,006 (CONKLIN et al.), U.S. Pat. No. 384,281 (RANDLEMAN et al.) U.S. Pat. No. 3,118,697 (WATTERS), U.S. Pat. No. 4,176,871 (STOVER), U.S. Pat. No. 578,832 (POPE), and the Canadian patents No. 348,489 (ALBERG), No. 267036 (PAGE) and No. 1,221,594 (BERNIER).

Most of prior art devices relate to scissor-like tongs (i.e. at least one pair of levers pivoting around at least one pivot). Some of said devices are further provided with long handles (i.e. levers) to allow a user to be at a substantial distance from the objects to be grasped and handled. However, it is difficult to handle objects with such prior art devices since the length of levers added to the length of the user's arms unduly increase the weight of the grasped object and therefore require substantial physical strength to perform an adequate handling. Furthermore, even though a user has great physical strength, it will always be difficult for said user to accurately control the handling of an object (such as a log).

Therefore, with prior art devices (e.g. tongs), it is difficult for the user to perform at the same time an accurate handling and a firm grasping of an object. Also, the prior art tongs do not allow the user to be positioned at a substantial distance from the object to handle. More particularly, when the object to be handled is a fire log, prior art tongs do not allow the user to be positioned at a safe distance from the fire, especially when said user wishes to modify the disposition of logs in the fire.

SUMMARY OF THE INVENTION

One of the primary object of the invention is to overcome the above-mentioned drawbacks and more particularly to provide a handling device allowing to easily and efficiently grasp and handle an object (such as a fire log).

Another object of the invention is to provide a handling device allowing to hold firmly an object to be handled.

Another important object of the invention is to provide a handling device allowing a user to easily grasp, handle and release an object without having to bend down over said device.

Another object of the invention is to provide a handling device that is cheap and easy to manufacture, long lasting and resistant. More particularly, the device according to the invention will have an affordable retail price.

Another object of the invention is a handling device that is efficient, dependable and adaptable for multiples purposes (e.g. fire logs, objects difficult to reach such as fruits on fruit trees, difficult to handle because of their temperature such as hot clothes in industrial laundry, or because of their nature such as hospital waste).

The above and related objects are embodied with a handling device comprising in combination:

a longitudinal axis;

an elongated sleeve provided with opposite ends and coaxial with the longitudinal axis, said opposite ends respectively defining a first end and a second end;

an elongated member having opposite ends, coaxial with the longitudinal axis and pivotally mounted inside the sleeve, said opposite ends respectively defining a first end and a second end;

at least one pair of grasps, each grasp of a same pair of grasps being respectively firmly attached to the first end of the sleeve member and to the first end of the elongated member;

a first prehension means firmly attached to the elongated member; and a second prehension means firmly attached to the sleeve.

The elongated sleeve member and the elongated member are adapted to pivot one with respect to the other and move said at least one pair of grasps between two extreme positions. These two extreme positions are a closed position where the grasps are close to each other and an open position where the grasps are distant from each other.

BRIEF DESCRIPTION OF THE DRAWINGS

The present invention will be more easily understood after reading the description of the following preferred embodiment, made with reference to the following drawings.

DESCRIPTION OF A PREFERRED EMBODIMENT OF THE INVENTION

Figure 1:
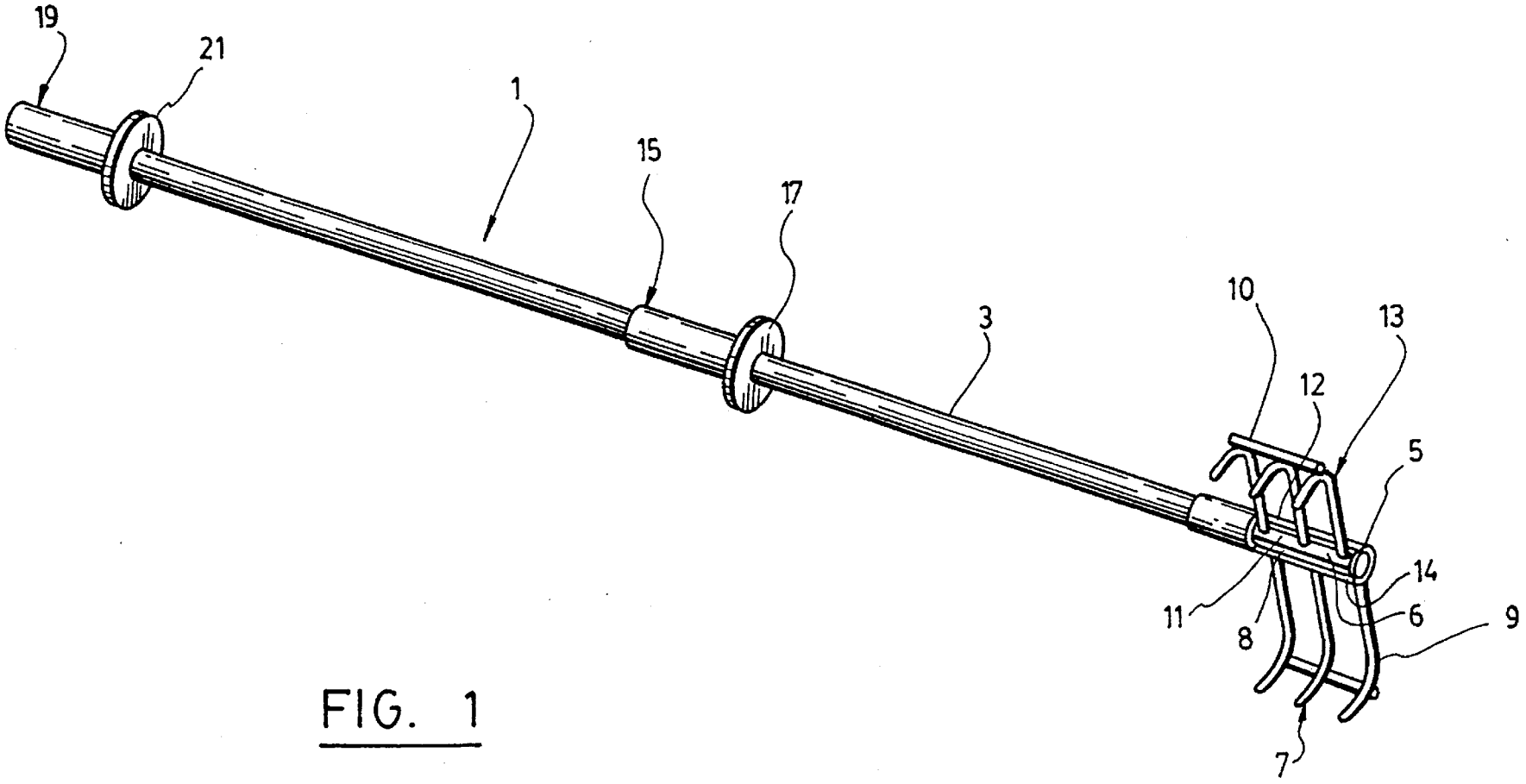
FIG. 1 is a perspective view of the preferred embodiment of a handling device according to the invention (in an open position)
Figure 2:
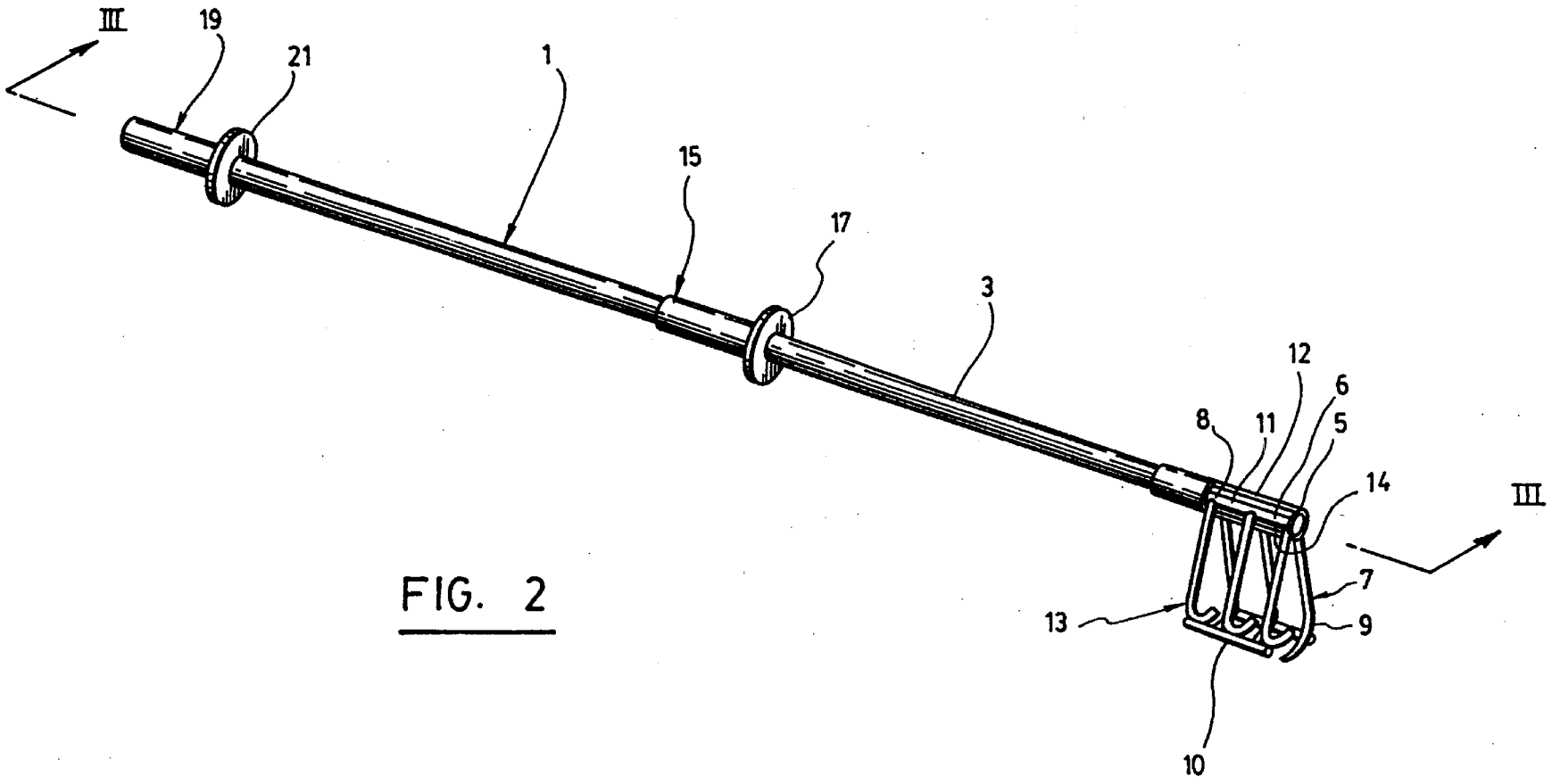
FIG. 2 is a perspective view of the handling device of FIG. 1 (in a closed position)

Referring to FIGS. 1 and 2, there is represented a preferred embodiment of a handling device (1) according to the invention. This device (1) comprises a longitudinal axis and an elongated sleeve (3) having opposite ends (i.e. a first end (5) and a second end (5*a*)). This sleeve (3) is coaxial with the longitudinal axis of said device (1). This sleeve (3) is preferably of a tubular shape and made of any appropriate material such as metal or alloys thereof (e.g. steel).

Figure 3:
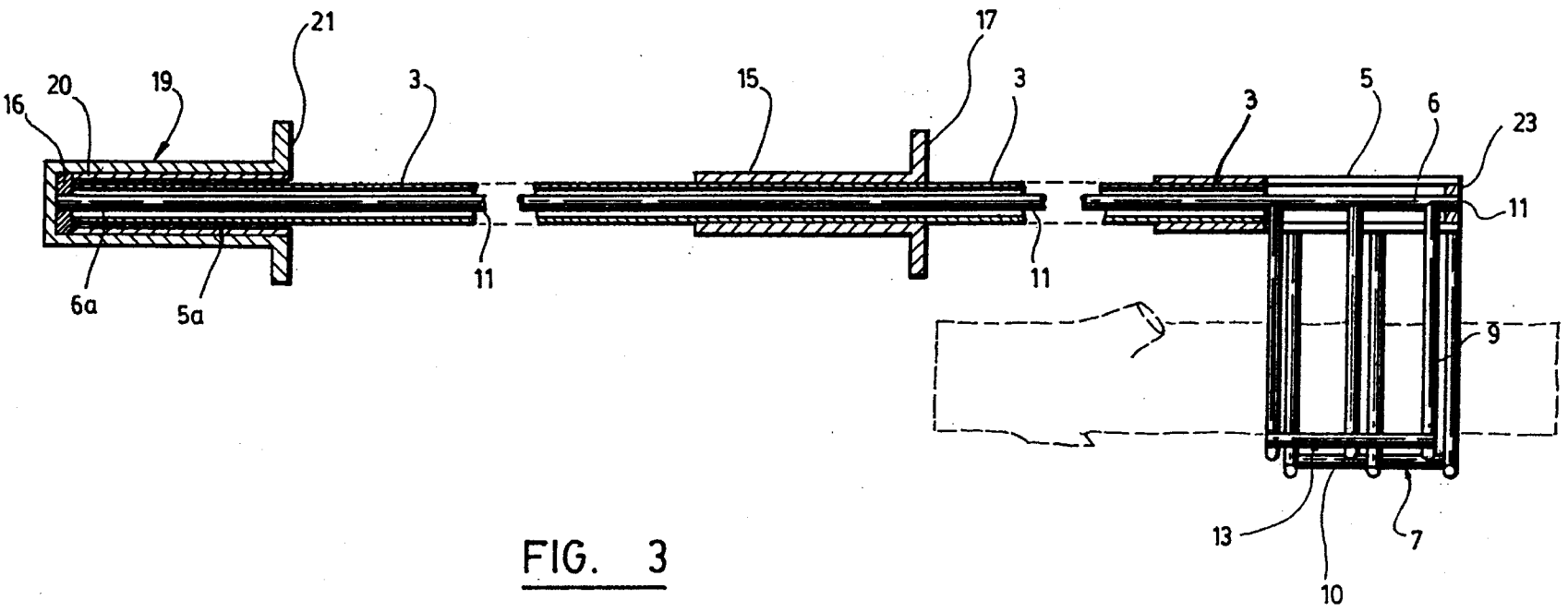
FIG. 3 is a partial cross-sectional view taken on line III—III of the handling device of FIG. 2.

This device (1) also comprises an elongated member (11) which is also coaxial with the longitudinal axis of said device (1). As best shown in FIG. 3, the elongated member (11) is advantageously pivotally mounted inside the sleeve (3) and has two opposite ends respectively defining a first end (6) and a second end (6*a*).

According to a particularly preferred embodiment of the invention, the elongated member (11) is a rod made of any appropriate material (especially a metal alloy such as steel). The device (1) also comprises a pair of grasps (7, 13). These grasps may be respectively firmly attached to the first end (5) of the sleeve (3), which may be in two parts, and to the first end of the elongated member (11). Advantageously, said grasps (7, 13) are enantiomorph. Each grasp (7, 13) may comprise a set of three "J"-shaped teeth (9) connected together by a transversal member (10). The teeth (9) as well as the transversal member (10) of each of said grasps (7, 13)

may be preferably made of any appropriate material (especially a metal alloy such as steel) and may be coated, depending on their intended use, with a resilient material (e.g. polymer material), to reduce the risk of the handled object slipping out of the grasps (7, 13).

Also, according to a preferred embodiment illustrated in FIGS. 1 to 3, the teeth of one set of teeth of one grasp are longitudinally shifted with respect to the teeth of the other set of teeth of the other grasp to allow said teeth to mutually engage one into the other (especially until transversal members (10) abut one against the other).

Although the sleeve (3) and the elongated member (11) are advantageously straight-shaped according to a preferred embodiment of the invention, they could also present non-linear shapes so far as the sleeve (3) (or the elongated member (11)) is flexible to pivot with respect to a rigid elongated member (11) (or sleeve (3)).

The sleeve (3) and the elongated member (11) are adapted to pivot one with respect to the other to move said grasps (7, 13) between two extreme positions, that is an open position (shown in FIG. 1) where the grasps (7, 13) are distant from each other and in a closed position (shown on FIGS. 2 and 3) where the grasps (7, 13) are close to each other.

According to a preferred embodiment of the invention, the first end (5) of the sleeve (3) may be provided with an opening (8). As best shown on FIG. 1, this opening (8) has opposite edges (12, 14) that are substantially parallel to the longitudinal axis of the handling device (1). The grasp (7) is firmly attached to one of these edges, in FIG. 1, to edge (12). Advantageously, the other edge (i.e. edge (14)) of the opening (8) may define a stopper for the grasp (13) of the elongated member (11).

According to the invention, the handling device (1) may further comprise a first prehension means (19) firmly attached to the elongated member (11) and second prehension means (15) firmly attached to the sleeve (3). The first prehension means (19) is advantageously provided to the second end (6*a*) of the elongated member (11) while the second prehension means (15)is advantageously provided to an intermediate portion of the sleeve (3).

According to a preferred embodiment of the invention, and as better shown on FIG. 3, the prehension means (19) may comprise a washer (16) mounted and firmly attached to the elongated member (11). A sleeve-shaped member (20), made of any appropriate material (especially a metal alloy such as steel), is advantageously connected to said washer (16) and pivotally engaged onto the second end (5*a*) of the sleeve (3) while substantially not in contact with it. Advantageously, this sleeve-shaped member (20) may be coated by an elastomer material (e.g. rubber).

More particularly, both prehension devices (15, 19) may comprise an elastomer (e.g. rubber) coating or sleeve which may be respectively provided with disk-shaped stoppers (17, 21). The user handling the device (1) may abut his hands against said stoppers (17, 21) to thus improve the handling of the device (1). Also, said stoppers (17, 21) and particularly the stopper (17) may prevent the hand from sliding along the sleeve (3) toward the grasps (7, 13) (to thus prevent said hand from being burned when the device (1) is used to handle objects in a fireplace).

One of the advantages of the invention is that it can easily be manufactured by using the following steps:

The pairs of grasps (7, 13) are firmly attached, for example by welding, on the first end (5) of the sleeve (3) and on the first end (6) of the elongated member (11). Then, the second prehension means (15) is firmly attached on the sleeve (3). Advantageously, when said second prehension means (15) is a rubber handle, it may be merely press fitted. Then, the first prehension means (19) may be firmly attached to the second end (6*a*) of the elongated member (11), for example by welding. According to a preferred embodiment, the sleeve-shaped member (20) may be firmly attached to a washer (16) which is engaged on the second end of the elongated member (11), and welded thereto. A washer (23) may be advantageously slidably engaged at the first end of the elongated member (11) and firmly attached, for example by welding, onto the first end (5) of the sleeve (3).

To operate the handling device (1) of the invention, a user grasps each of the prehension means (15, 19) with each hand. Then, he may move the grasps (7, 13) between the open and the closed positions by exerting a pivotal movement on the sleeve (3) and/or on the elongated member (11). Thus, the user may grasp an object, like a fire log, by closing the pair of grasps on it, and, his hands remaining in the same position, hold it and carry it to another place. The release of the object may be achieved by exerting on the prehension means (15, 19) a pivotal movement in a direction opposite to the one exerted for closing grasps (7, 13). It should be noted that, according to a preferred embodiment of the invention, the presence on the first end (5) of the sleeve (3) of a stopper limiting the pivoting movement between the sleeve (3) and the elongated member (11) allows the user not to unduly twist his wrists nor reposition his hands on the prehension means (15, 19).

The sleeve (3), the elongated member (11), the grasps (7, 13) and the washers (16, 23) are preferably made of any appropriate material such as metal or alloys thereof (e.g. steel). However, when they are not intended to be used for handling fire logs, they could also be made of other appropriate materials such as plastics, aluminum, etc. Furthermore, the manufacturing of all constitutive parts of the device (1) may be achieved according to techniques well-known to skilled workmen.

Of course, the above description of the invention could be extended to any variation that any person in the art would or could think of.

I claim:

1. A handling device comprising in combination:

a longitudinal axis;

an elongated sleeve provided with opposite ends and coaxial with the longitudinal axis, said opposite ends respectively defining a first end and a second end;

an elongated member having opposite ends, coaxial with the longitudinal axis and pivotally mounted inside the elongated sleeve member, said opposite ends respectively defining a first end and a second end;

one pair of grasps, each grasp of said pair being respectively firmly attached to the first end of the elongated sleeve member and to the first end of the rod, each of said grasps comprising of set of three "J"-shaped teeth connected together by a transversal member;

a first prehension means firmly attached to the second end of the rod and comprising a rubber handle and a disk-shaped stopper; and a second prehension means firmly attached to an intermediate portion of the elongated sleeve member and comprising a rubber handle and a disk-shaped stopper;

the elongated sleeve member and the rod being adapted to pivot one with respect to the other and move said one pair of grasps between two extreme positions, that is a closed position where the grasps are close to each other and an open position where the grasps are distant from each other; and a portion of the first end of the elongated sleeve member being provided with an opening having opposite edges substantially parallel to the longitudinal axis of the device, the grasp firmly attached to the elongated sleeve member being firmly attached to one of said edges, while the other edge of the opening provided at the portion of the first end of the elongated sleeve member defining a stopper for the grasp is firmly attached to the rod.

* * * * *